US008863328B2

(12) United States Patent
Dwyer et al.

(10) Patent No.: US 8,863,328 B2
(45) Date of Patent: Oct. 21, 2014

(54) BED FRAMES WITH FRAME COVER ASSEMBLIES

(71) Applicant: Mantua Manufacturing Company, Walton Hills, OH (US)

(72) Inventors: Neil Dwyer, Parma, OH (US); David Jaffe, Orange Village, OH (US)

(73) Assignee: Mantua Manufacturing Company, Walton Hills, OH (US)

( * ) Notice: Subject to any disclaimer, the term of this patent is extended or adjusted under 35 U.S.C. 154(b) by 0 days.

(21) Appl. No.: 13/836,783

(22) Filed: Mar. 15, 2013

(65) Prior Publication Data

US 2014/0208507 A1 Jul. 31, 2014

Related U.S. Application Data

(60) Provisional application No. 61/756,603, filed on Jan. 25, 2013.

(51) Int. Cl.
*A47C 21/00* (2006.01)

(52) U.S. Cl.
CPC ..... *A47C 21/00* (2013.01)
USPC ..... 5/493; 5/280; 5/286

(58) Field of Classification Search
USPC ..... 5/286, 287, 493, 663, 200.1, 280
See application file for complete search history.

(56) References Cited

U.S. PATENT DOCUMENTS

| | | | | |
|---|---|---|---|---|
| 3,429,539 | A | 2/1969 | Lucietto et al. | |
| 3,546,725 | A * | 12/1970 | Tambascio | 5/200.1 |
| 5,688,569 | A * | 11/1997 | Gilmore et al. | 428/31 |
| 5,867,853 | A * | 2/1999 | Feld | 5/663 |
| 6,076,212 | A * | 6/2000 | Feld | 5/663 |
| 6,321,399 | B1 * | 11/2001 | Walterscheid | 5/118 |
| 7,100,228 | B2 * | 9/2006 | Polevoy et al. | 5/663 |
| 7,363,665 | B2 * | 4/2008 | Polevoy et al. | 5/200.1 |
| 8,006,328 | B2 * | 8/2011 | Polevoy et al. | 5/200.1 |
| 8,234,734 | B2 * | 8/2012 | Perry | 5/663 |
| 2004/0194217 | A1 * | 10/2004 | Polevoy et al. | 5/663 |
| 2005/0278858 | A1 * | 12/2005 | Polevoy et al. | 5/663 |

FOREIGN PATENT DOCUMENTS

| | | |
|---|---|---|
| EP | 0 180 099 B1 | 5/1986 |
| JP | 07124037 A | 5/1995 |
| JP | 3814757 | 6/2006 |
| KR | 20031041571 | 4/2003 |
| WO | WO 03/011079 A1 | 2/2003 |

* cited by examiner

*Primary Examiner* — Nicholas Polito
*Assistant Examiner* — Richard G Davis
(74) *Attorney, Agent, or Firm* — Black, McCuskey, Souers & Arbaugh, LPA

(57) ABSTRACT

The present disclosure and related inventions describe various embodiments of cover assemblies for bed frames which are both structural and aesthetic which provide a wide variety of bed frame assemblies of unique construction. The bed frame assembly removably attaches to the outer surface of the longitudinal members of a bed frame to conceal exposed bed frame members and provide a more pleasant, customized view of an entire sleep structure.

13 Claims, 7 Drawing Sheets

BED FRAMES WITH FRAME COVER ASSEMBLIES

RELATED APPLICATIONS

This application is related to U.S. provisional patent application Ser. No. 61/756,603, filed Jan. 25, 2013.

FIELD OF THE INVENTION

The present disclosure is in the general field of home and hospitality furnishings, and sleep furnishings in particular.

BACKGROUND OF THE INVENTION

Bed frames that are used to elevate and support conventional sleep sets of the western world—including a foundation or box spring underlying a mattress—are in the general form of orthogonally arranged frame members, including two longitudinal and parallel frame members configured to run along and underneath longitudinal edges of the foundation, and two or more cross members which extend between the longitudinal members and transversely across a width of the foundation. The longitudinal members are commonly formed of angle iron, for example in the form of L-angle steel rails with a horizontal flange for positioning under a side longitudinal edge of a foundation, and the corresponding vertical flange extending upward adjacent to and parallel with a longitudinal side of the foundation. The cross members may be L-shaped or T-shaped in cross section, with a flat horizontal upper surface for bearing against the underside of a foundation. Legs are attached to the frame, to either the longitudinal members or cross members or at the intersections thereof to elevate the frame.

The head ends of the longitudinal members are generally positioned at the head end of the sleep set and aligned with a head board if provided, and the length of the longitudinal members is conventionally five or six feet, and generally shorter than the length of the foundation positioned thereon. Therefore the sleep set extends over the bed frame at the foot end. Bed frames of this type are generally visible, particularly the vertical flange of the longitudinal members, which may be covered only by a bed spread of comforter which hangs over the sides of the mattress and foundation. In showrooms of sleep set and furniture retailers, the bed frames are fully exposed. Although the steel of the frames is finished and coated or painted, the appearance is utilitarian and non-aesthetic.

SUMMARY

The present disclosure and related inventions describe various embodiments of cover assemblies for bed frames which are both structural and aesthetic which provide a wide variety of bed frame assemblies of unique construction. The bed frame assembly removably attaches to the outer surface of the longitudinal members of a bed frame to conceal exposed bed frame members and provide a more pleasant, customized view of an entire sleep structure.

DETAILED DESCRIPTION

The present disclosure and related inventions provides improved bed frames and bed frame assemblies, including structural bed frames in combination with frame covers and frame cover systems. As shown in the accompanying drawings, FIGS. 1 through 14, a bed frame, indicated generally at F in FIGS. 1 and 9, has longitudinal members L1 and L2 and interconnected and transversely disposed cross members C1 and C2. The frame F may be elevated and supported by legs LG and casters CS.

Figure 1:
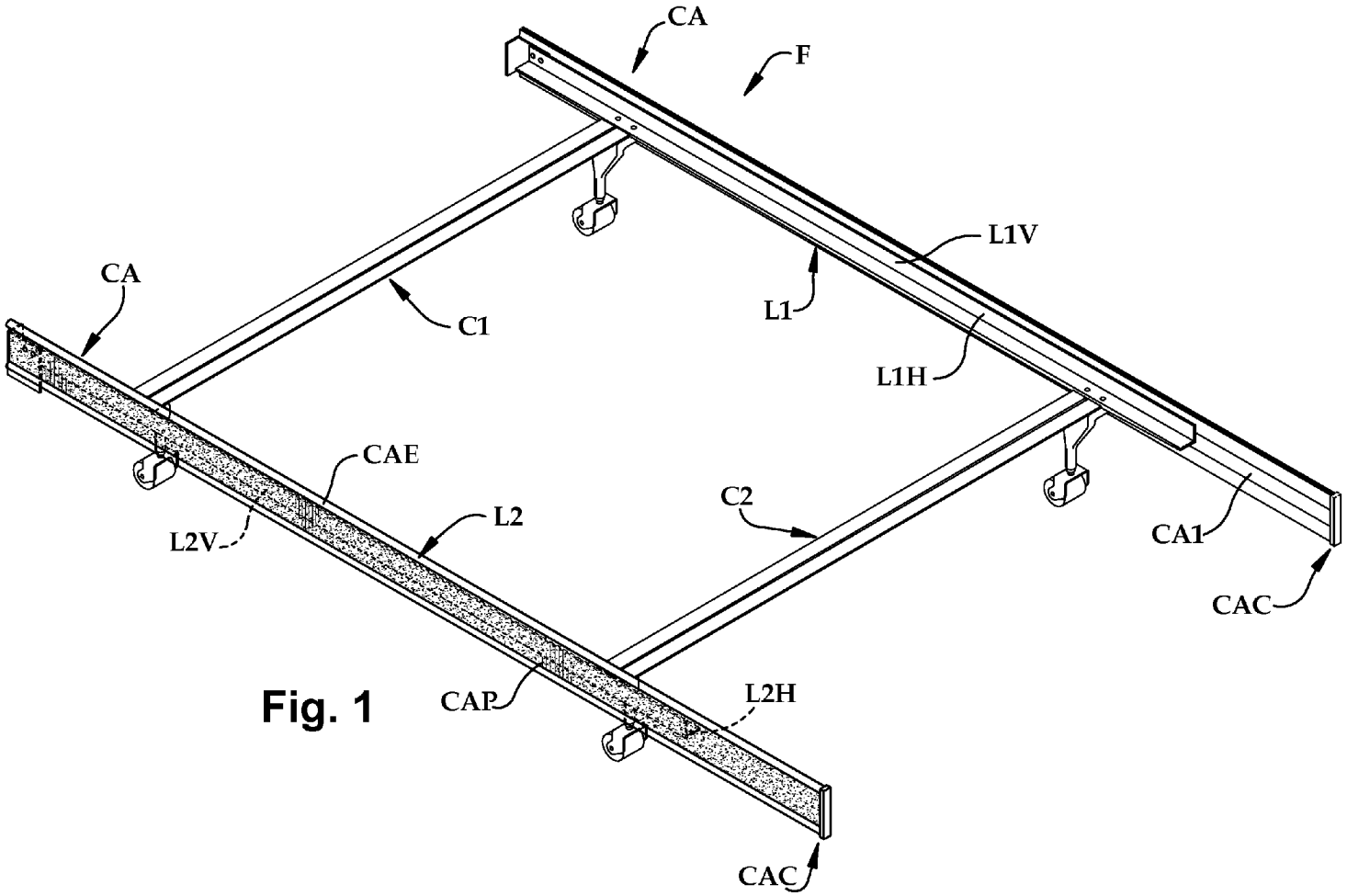
FIG. 1 is a perspective view of a first embodiment of the bed frame with bed frame cover assembly of the present invention.
Figure 3:
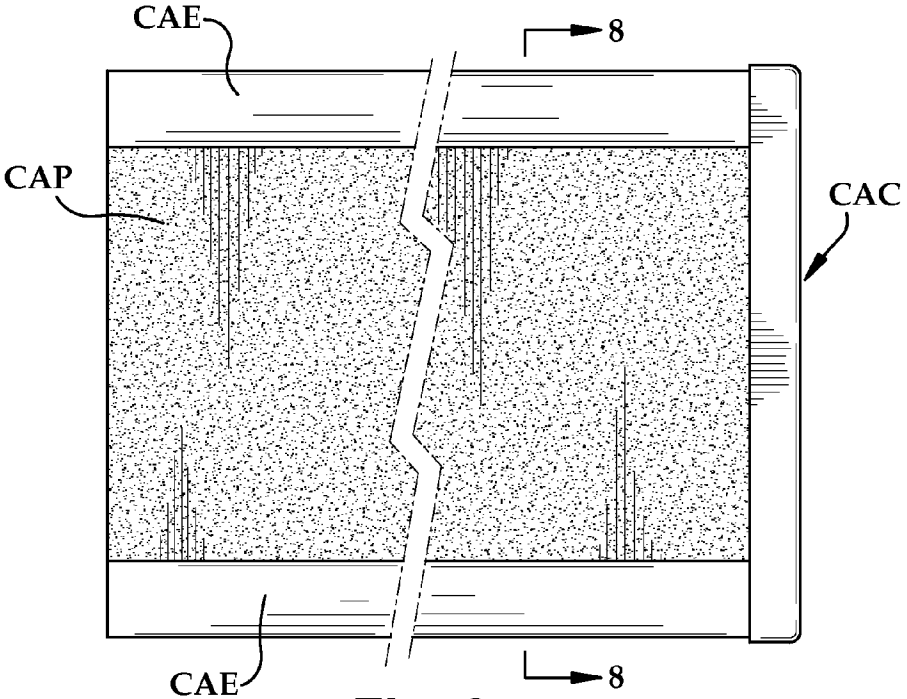
FIG. 3 is a front view of the bed frame cover assembly of FIG. 2.
Figure 4:
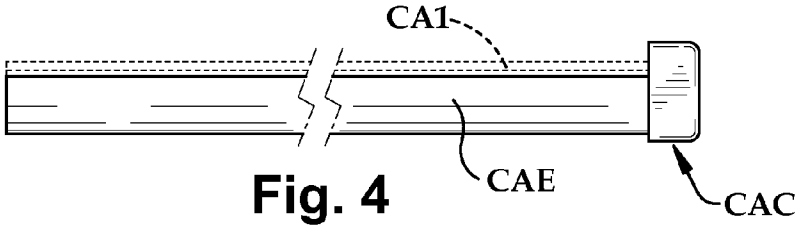
FIG. 4 is a top view of the bed frame cover assembly of FIG. 2.
Figure 2:
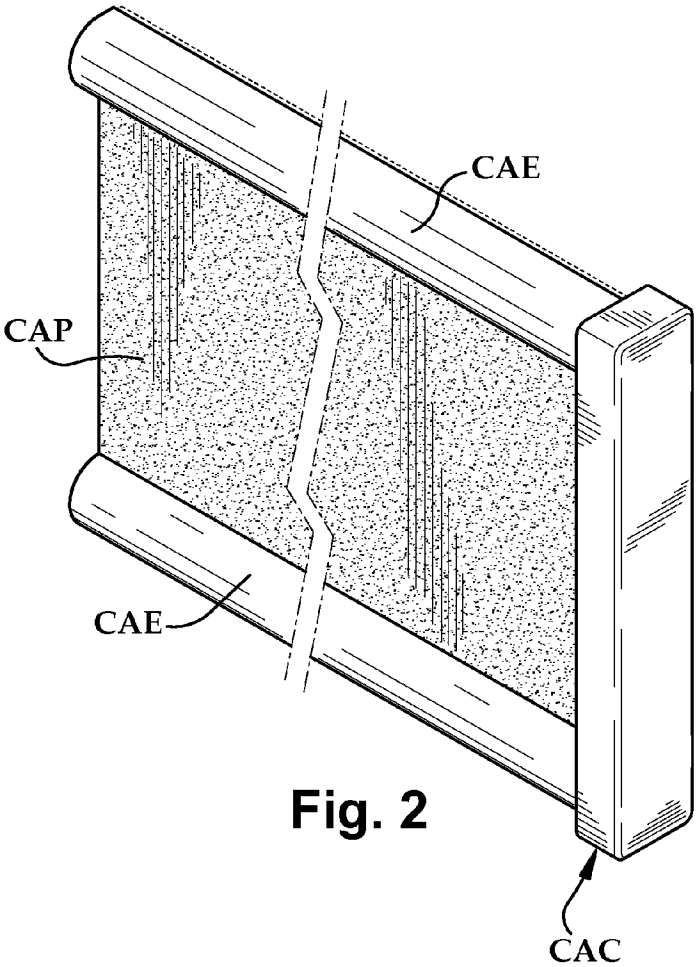
FIG. 2 is a perspective view of a portion of the outer surface of the bed frame cover assembly of FIG. 1.
Figure 8:
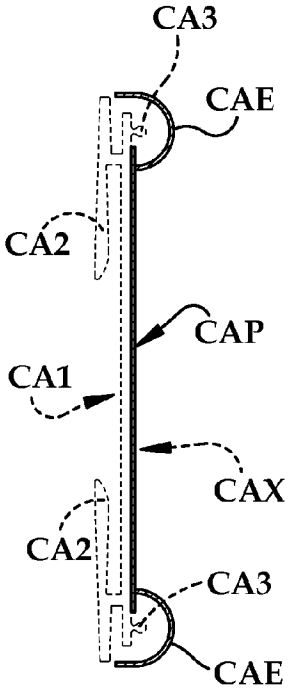
FIG. 8 is a cross sectional view of the cover assembly of FIG. 3 from the perspective of arrows 8-8.
Figure 7:
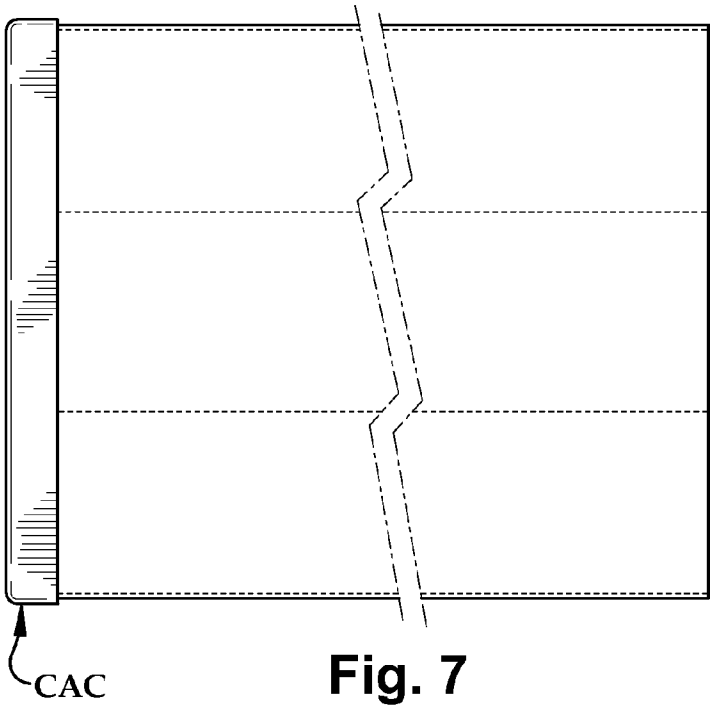
FIG. 7 is a front view of the inner surface of the bed frame cover assembly of FIG. 2.
Figure 6:
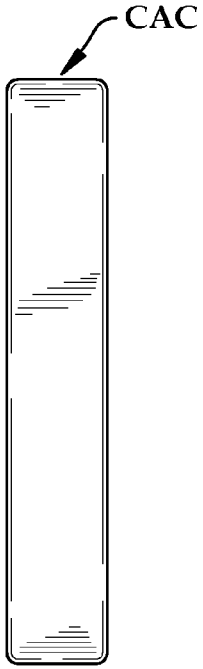
FIG. 6 is an end view of the bed frame cover assembly of FIG. 2.
Figure 5:
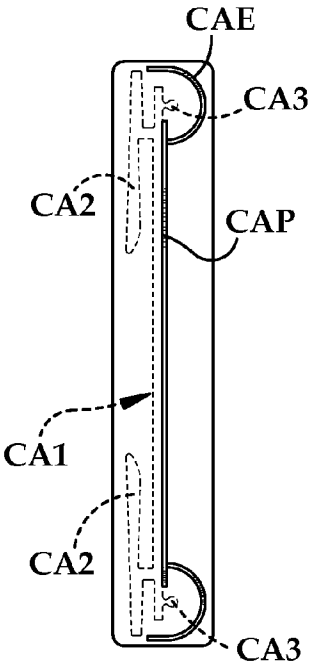
FIG. 5 is a cross-sectional view of the bed frame cover assembly of FIG. 3.
Figure 9:
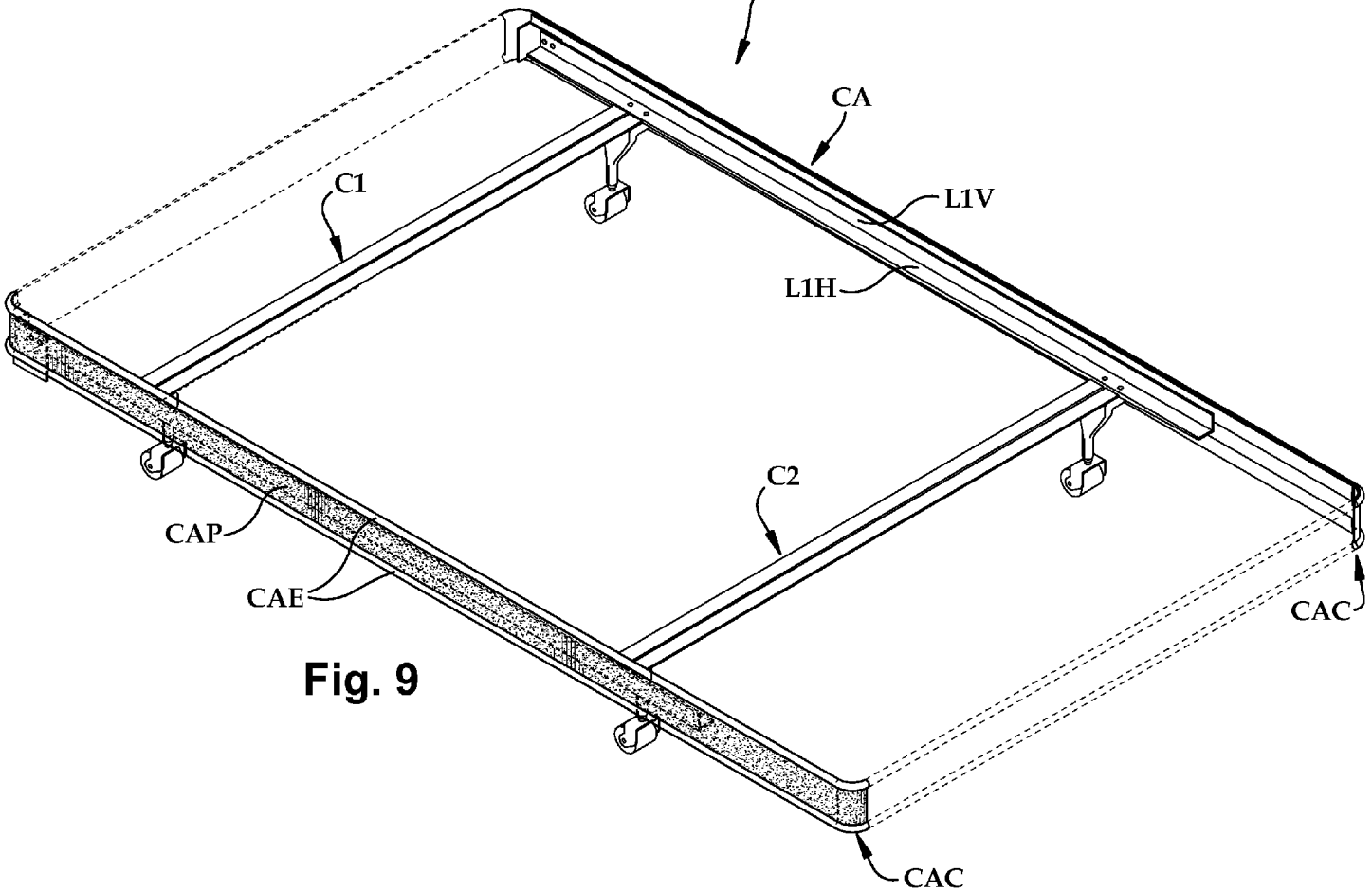
FIG. 9 is a perspective view of a second embodiment of the bed frame of the present invention.
Figure 10:
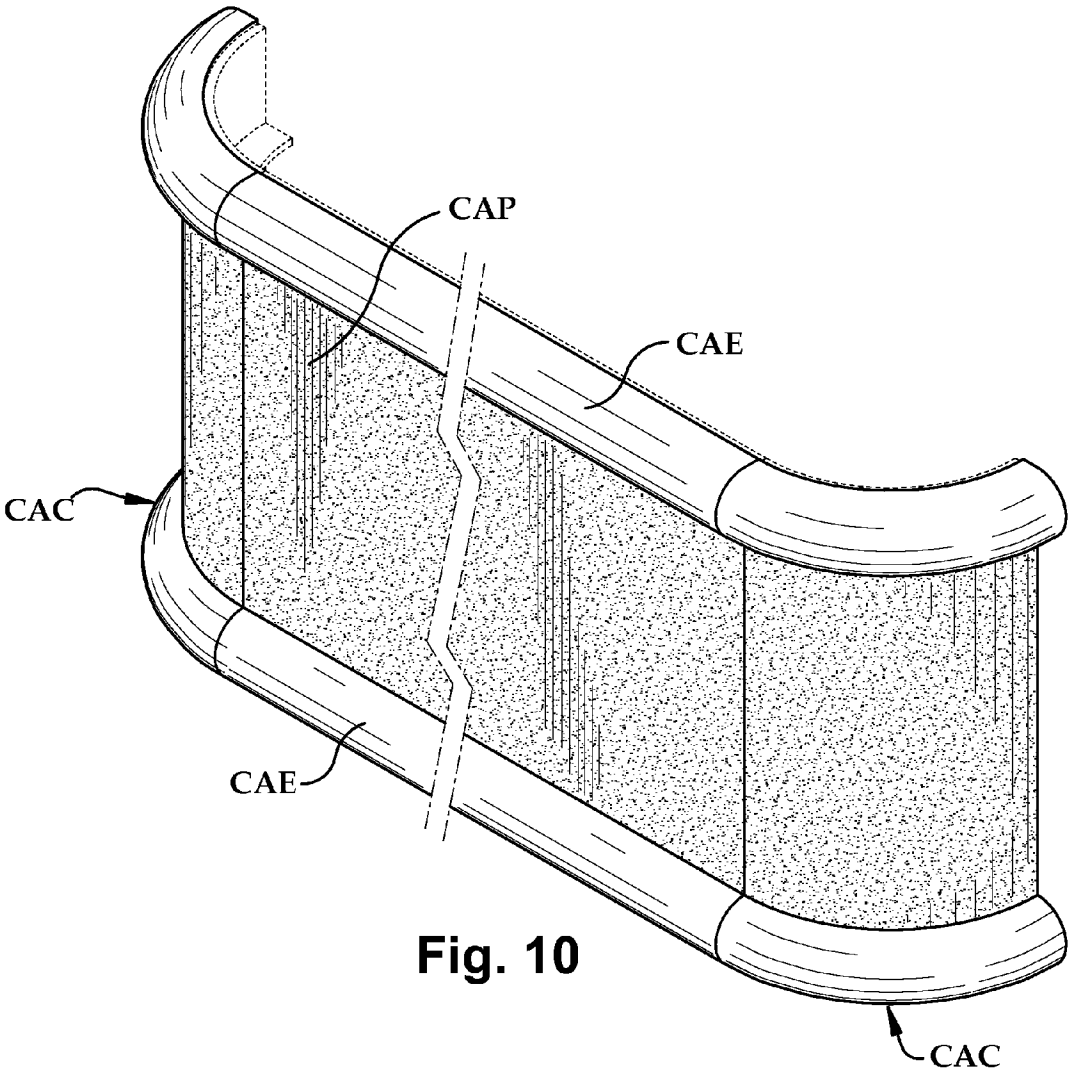
FIG. 10 is a perspective view of a portion of the bed frame cover assembly of FIG. 9.
Figure 12:
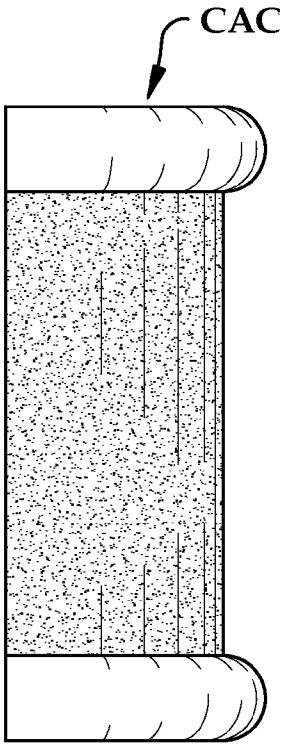
FIG. 12 is a side view of the cover assembly of FIG. 9.
Figure 11:
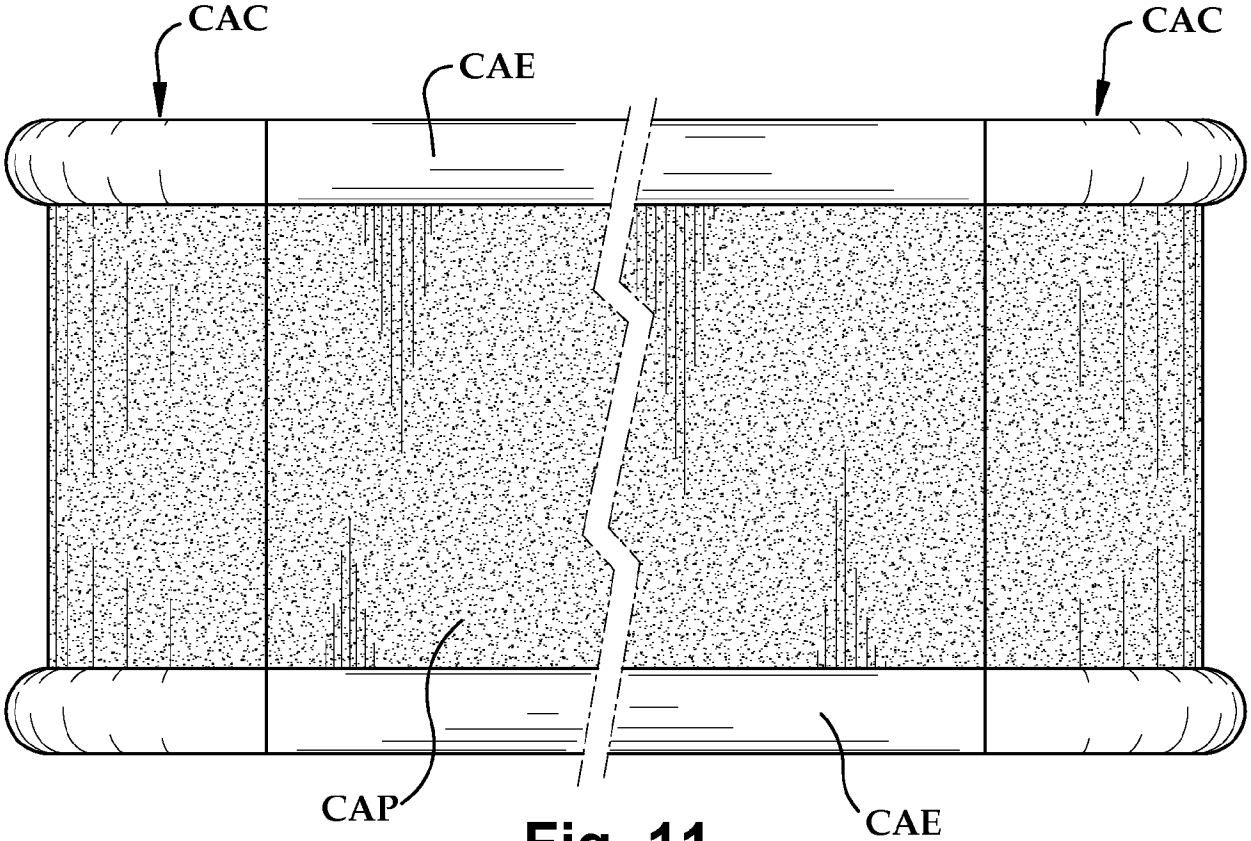
FIG. 11 is a front view of the cover assembly of FIG. 9.
Figure 13:
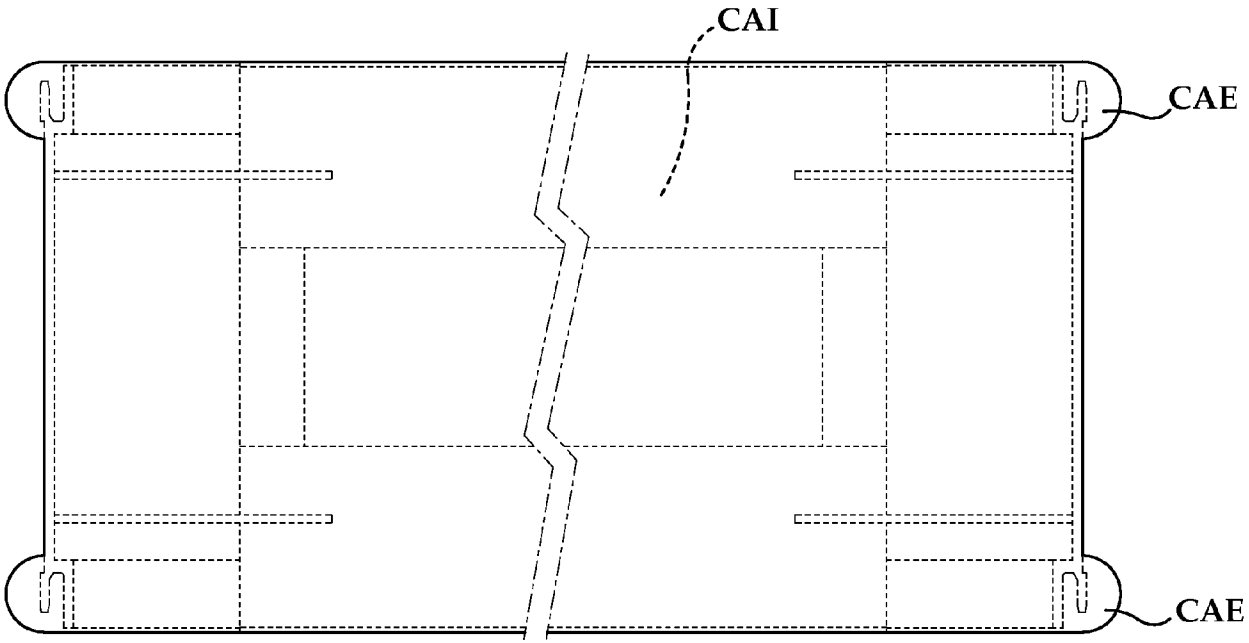
FIG. 13 is a top view of the bed frame and cover assembly of FIG. 9.
Figure 14:
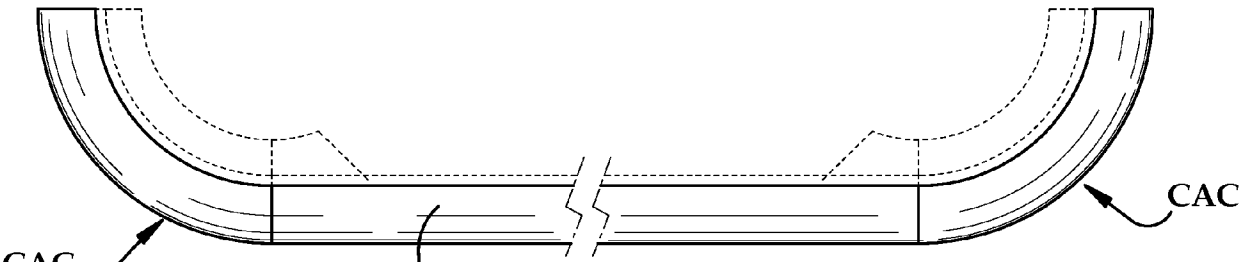
FIG. 14 is a top view of the cover assembly of FIG. 9.

Each longitudinal member L1 and L2 has a horizontal flange, L1H, L2H, and a vertical flange L1V, L2V, which as described is generally aligned with side walls of a foundation and mattress when the frame and sleep set are combined. A cover assembly, indicated generally at CA (also referred to herein as a "bed frame cover assembly" or "bed frame cover"), and shown in further detail in FIGS. 2 through 8 and FIGS. 10 through 14, is attached to each of the longitudinal frame members L1, L2, and in this particular embodiment to the vertical flange L1V, L2V of each longitudinal frame member L1, L2. In an exemplary embodiment, a cover assembly CA includes a generally planar panel CA1, which has a profile or height dimension generally equal to or greater than a height dimension of the vertical flange L1V, L2V, and a length dimension equal to or greater than a length dimension of the vertical flange L1V, L2V. A primary interior surface of the cover assembly panel, indicated as CAI, is configured to be positioned parallel to and immediately adjacent the outer facing surface of each vertical flange L1V, L2V, as shown in FIGS. 1 and 9. As shown in FIG. 8, one or more engagement tabs CA2 can be provided to extend from the interior side CAI or the upper and lower edges of the cover panel CA1, forming a channel between the tabs and the interior side of panel CA1 to receive a portion of the vertical flange L1V, L2V, such as for example the upper end and edge of the flange L1V, L2V. This is one representative configuration for securing the cover assembly panel CA1 to the vertical flange L1V, L2V. Other attachment configurations are possible, such as for example only a single engagement tab CA2 that runs part of or an entire length of the cover assembly panel CA1; clips which are fastened to the panel CA1 and configured for engagement with the vertical flanges L1V, L2V; other formations or structures integral to the panel CA1 that mechanically engage the longitudinal members L1, L2 in any suitable manner, adhesive, magnetic or mechanical bonding of the panel CA1 to the longitudinal members L1, L2 or to the vertical flanges L1V, L2V only or to the horizontal flanges L1H, L2H only; apertures in the vertical flanges L1V, L2V or to the horizontal flanges L1H, L2H to receive a fastening projection that extends from the panel CA1.

An exterior side of the cover assembly panel CA1, indicated as CAX, can serve as the primary exposed surface of the bed frame cover assembly CA, or be configured to receive a cover panel insert, indicated as CAP, that fits over and substantially flush against the exterior side CAX of panel CA1. The panel CA1 may further include structural features such as projections CA3 for engaging and holding a cover panel insert CAP, and preferably holding the cover panel insert CAP in a removable manner, whereby the cover panel insert CAP can be quickly and easily installed with the panel CA1 and removed and interchanged with a different insert CAP. In preferred embodiments, the cover panel insert CAP is a generally flexible thin sheet material that substantially covers the exterior side CAX of panel CA1, and made of any suitable material of any color, texture or with any other structural or aesthetic attributes and features. When made of flexible sheet material, such as in the form of an extrusion of plastic, the insert panel CAP may be flexed in different dimensions to facilitate engagement and disengagement with panel CA1. Also, the insert panel CAP can be dimensioned to bow slightly outward from the generally planar exterior surface CAX of panel CA1, for example with the upper and lower edges biased against the projection CA3. Alternatively or additionally, an edge structure or component, indicated as CAE and also referred to as a "cover assembly edge", can be attached to or formed integrally with the cover panel CA1, to run along one or both edges of the panel CA1. The cover assembly edge CAE can fit over the insert panel CAP as shown in FIG. 8, or the edges of the insert panel CAP can butt against the edges CAE. Other edge structures and arrangements for edges of the cover assembly CA in general are contemplated.

As also shown in the Figures, cover assembly caps, indicated as CAC, can be provided on one or both ends of the panels CA1. The caps CAC are configured to attach to the panels CA1 and to extend over the ends of any insert panel CAP and any edge structure of component CAE. One embodiment of caps CAC is shown in FIGS. 2 through 7, and is generally planar and orthogonal to panel CA1 and insert panel CAP. An alternate embodiment of a cap CAC is shown in FIGS. 9 through 14, which has the same general profile of panel CA1, insert panel CAP and edges CAE in arcuate or curved form. A foot end section of the cover assembly CA could be provided between the distal ends of the opposing end caps CAC shown in FIG. 9.

The disclosure and related inventions thus provide various embodiments of cover assemblies for bad frames which are both structural and aesthetic, and which enable a wide variety of bed frame assemblies of unique construction. It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A bed frame cover assembly comprising:

a planar panel having an interior side and an exterior side, first and second projections which project from the exterior side of the planar panel and configured to engage and hold a cover panel insert to substantially cover the exterior side of the planar panel, and first and second engagement tabs which extend from the interior side of the planar panel and configured for engagement with a bed frame member;

the cover panel insert positioned against the exterior side of the planar panel and between the first and second projections of the planar panel;

first and second cover assembly edge pieces attached respectively to each of the first and second projections of the planar panel and overlapping an edge of the cover panel insert;

a cover assembly cap attached to the planar panel and extending over an edge of the cover panel insert and the cover assembly edge pieces, wherein the bed frame cover assembly is operative to fit over longitudinal members of a bed frame.

2. The bed frame cover assembly of claim 1, wherein the cover panel insert is a flexible thin sheet material.

3. The bed frame cover assembly of claim 1, wherein the cover panel insert may be flexed in different dimensions to facilitate engagement and disengagement with the first and second projections of the planar panel.

4. The bed frame cover assembly of claim 1, wherein the first and second projections are located on opposing vertical edges of the planar panel to facilitate attachment of the cover panel insert.

5. The bed frame cover assembly of claim 1, wherein the first and second engagement tabs are located respectively on each opposing vertical edge of the interior side of the planar panel for attachment of the cover assembly to a bed frame.

6. The bed frame cover assembly of claim 1, wherein the cover assembly edge pieces have a curved form.

7. The bed frame cover assembly of claim 1 further comprising a foot end section which is inserted between the distal ends of the opposing cover assembly caps.

8. A bed frame cover assembly comprising:

a generally planar cover panel having an interior side and an exterior side, two opposed engagement tabs which extend from the interior side, the two engagement tabs forming a channel between the two engagement tabs and the interior side of the cover panel for receiving and removably engaging with a longitudinal member of a bed frame; first and second projections which project from the interior side of the cover panel proximate to corresponding parallel longitudinal edges of the cover panel;

a cover panel insert positioned over the exterior side of the cover panel and between the first and second projections that is removably attached to an exterior surface of the cover panel;

first and second cover assembly edge pieces, the first cover assembly edge piece attached to the first projection and extending over a portion of the cover panel insert proximate to the first projection, and the second cover assembly edge piece attached to the second projection and extending over a portion of the cover panel proximate to the second projection;

a cover assembly cap attached to one end of the cover panel and extending over an end of the cover panel insert and over an end of the cover assembly edge.

9. The bed frame cover assembly of claim 8, wherein the cover panel insert is a flexible thin sheet material.

10. The bed frame cover assembly of claim 8, wherein the cover panel insert and the cover panel assembly cap contain curved edges.

11. A bed frame cover assembly comprising;

a generally planar and elongate cover panel which is dimensioned to be attached to an outer surface of a vertical flange of a longitudinal member of a bed frame, first and second longitudinal members of the bed frame being parallel and spaced apart and extending between a transversely disposed head member of the bed frame and a transversely disposed foot member of the bed frame; the cover panel having first and second engagement tabs which extend from an interior side for engagement with the vertical flange of a longitudinal member of a bed frame, and first and second projections which project from an exterior side;

a cover panel insert removably positioned over the exterior side of the cover panel and between the first and second projections on the exterior side of the cover panel;

first and second cover assembly edge pieces attached respectively to the first and second projection of the cover panel, each first and second cover assembly edge piece extending over an edge of the cover panel insert;

and a cover assembly cap attached over the distal ends of the cover panel insert and the first and second cover assembly edge pieces.

12. The bed frame cover assembly of claim 11, wherein the cover panel has a length dimension which is longer than the length of the longitudinal member of the bed frame to which it is attached.

13. The bed frame cover assembly of claim 11, wherein the cover panel has a length dimension which is equal to the length of the longitudinal member of the bed frame to which it is attached.

* * * * *